US007895812B2

(12) United States Patent
Svensson

(10) Patent No.: US 7,895,812 B2
(45) Date of Patent: Mar. 1, 2011

(54) MACHINE FOR RAISING PLANAR ARTICLES

(76) Inventor: Mikael Svensson, Haverdal (SE)

( * ) Notice: Subject to any disclaimer, the term of this patent is extended or adjusted under 35 U.S.C. 154(b) by 378 days.

(21) Appl. No.: 11/992,442

(22) PCT Filed: Sep. 26, 2006

(86) PCT No.: PCT/IB2006/002665

§ 371 (c)(1),
(2), (4) Date: Mar. 21, 2008

(87) PCT Pub. No.: WO2007/034319

PCT Pub. Date: Mar. 29, 2007

(65) Prior Publication Data

US 2009/0308026 A1 Dec. 17, 2009

(30) Foreign Application Priority Data

Sep. 26, 2005 (DK) ..... 2005 01333

(51) Int. Cl.
*B65B 43/26* (2006.01)

(52) U.S. Cl. ..... 53/381.1; 53/382.2; 53/383.1; 493/130; 493/144; 493/183

(58) Field of Classification Search ..... 53/381.1, 53/382.2, 382.3, 383.1, 387.1; 493/144, 493/182, 177–179, 183, 150, 151, 156, 130, 493/131, 141
See application file for complete search history.

(56) References Cited

U.S. PATENT DOCUMENTS

| | | | | |
|---|---|---|---|---|
| 1,402,259 | A * | 1/1922 | Smith | 493/68 |
| 2,994,467 | A | 8/1961 | Evanstein | |
| 3,513,757 | A * | 5/1970 | Di Frank | 493/131 |
| 4,460,349 | A | 7/1984 | Charron | |
| 4,562,687 | A * | 1/1986 | Green, Jr. | 53/376.5 |
| 4,578,054 | A * | 3/1986 | Herrin | 493/126 |
| 4,744,197 | A * | 5/1988 | Conforto et al. | 53/397 |
| 4,785,610 | A * | 11/1988 | Valenti | 53/537 |
| 5,024,641 | A * | 6/1991 | Boisseau | 493/171 |
| 5,243,808 | A * | 9/1993 | Landrum | 53/484 |
| 5,605,027 | A | 2/1997 | Scroggin et al. | |
| 5,782,732 | A * | 7/1998 | Herrin | 493/131 |
| 5,971,906 | A * | 10/1999 | Tharpe et al. | 493/131 |
| 6,038,837 | A * | 3/2000 | Odenthal | 53/484 |
| 6,622,461 | B2 * | 9/2003 | Gambetti | 53/491 |

FOREIGN PATENT DOCUMENTS

| | | |
|---|---|---|
| EP | 0048824 | 4/1982 |
| FR | 2185540 | 1/1974 |
| GB | 2163122 | 2/1986 |

* cited by examiner

*Primary Examiner* — Thanh K Truong

(74) *Attorney, Agent, or Firm* — Cooper & Dunham, LLP

(57) ABSTRACT

A machine for raising planar articles (2), preferably made of cardboard, corrugated cardboard or plastics, in order to manufacture box-shaped or crate-shaped packaging. The machine comprises at least one main conveyor (16) for advancing the planar articles (2) one at a time and side forming means (8) for turning the side panels (5*b*) of the articles predominantly 90° upwards with respect to the bottom panel (4) of the article (2). Moreover, the machine is provided with transversely arranged end forming means (15) for turning the end panels (6*a*, 6*b*) of the articles substantially 90° upwards and optionally also turning the end portions (5*b'*, 5*b''*) of the side panels (5*b*) substantially 90° with respect to the remaining portion of the side panels. Finally, there are joining means (12, 20) for joining the side panels (5*a*, 5*b*) and the end panels (6*a*, 6*b*) of the articles. This provides a machine requiring less space than the known one but remaining very reliable.

8 Claims, 2 Drawing Sheets

MACHINE FOR RAISING PLANAR ARTICLES

TECHNICAL FIELD

The invention relates to a machine for raising planar articles, preferably made of cardboard, corrugated cardboard or plastics, in order to manufacture box-shaped or crate-shaped packagings, and where each article is provided with a bottom panel, longitudinal side panels, transverse end panels and optionally a cover panel.

BACKGROUND ART

DK Patent No. 171512 B1 discloses a machine for packaging articles of the sleeve-type, i.e. having the shape of a tube with rectangular cross-section, and being closable at both ends. The machine is provided with the continuous conveyors partially overlapping each other, thus resulting in a comparatively bulky machine.

The object of the invention is to provide a machine of the type disclosed in the preamble, which is less bulky than the known machine, but nevertheless very reliable.

DISCLOSURE OF INVENTION

The machine according to the invention is characterized in that it comprises at least one main conveyor, the planar articles being advanced one at a time by means of said main conveyor, and side forming means able to exert pressure on the longitudinal side panels of the article and rotating them predominantly 90° upwards with respect to the plane of the bottom panel, as well as transversely arranged end forming means movable in longitudinal direction of the main conveyor and able to exert pressure on said end panels and turning them predominantly 90° with respect to the plane of said bottom panel, when the end panels of a planar article are positioned opposite said end forming means, and that the machine is provided with joining means for joining the side panels and the end panels of each article. In this way, the machine requires less space in height compared to the known machine. In addition, the machine is highly reliable.

Moreover, according to the invention, the joining means may comprise an inner e.g. pivotable support plate movable between a front position at a front corner of the packaging and a rear position at a rear corner of the packaging, as well as a low retaining plate mounted on a secondary conveyor belt, said retaining plate being movable from a position just in front of the front end panel of the packaging to a position just behind the rear end panel of the packaging by means of the secondary conveyor belt, where a clamping action between the retaining plate and the support plate may be provided in both positions. In this way it is possible to manufacture the corners of the packaging in a particularly reliable manner, since said plates press an end portion on the side panel of the article against a portion on the end panel of said article.

According to the invention the joining means may be comprised of glue supply means for supplying glue to the area between the retaining plate and the support plate In this manner, it is possible to easily supply glue to the portions on the end panel and the side panel of the article to overlap each other with respect to joining them.

Moreover, according to the invention, the joining means may be comprised of stapling means for stapling each end panel to a portion of the adjacent side panel.

Furthermore, according to the invention, the retaining plate may be mounted on the lower continuous secondary belt in such a manner that the retaining plate permanently projects therefrom at right angles. Thus, the joint formed by the retaining plate is more solid.

Further, according to the invention, the support plate may be adapted and mounted in such a manner that it can be moved translationally with respect to the inside of the packaging from a position at a front corner inside the packaging—to a rear corner inside the packaging, and is finally rotatable upwards from the article so that the latter is exposed. Thus, the support plate and the retaining plate are able to hold an end panel and a side panel (belonging to the packaging) together in a very efficient manner in order to join those panels at each packaging corner.

According to the invention, each article may be provided with two short parallel slots at each of its end panels to define a front wall and a rear wall, respectively, of the packaging, while rectilinear narrow depressions may be formed in the article at those locations of the article where the finished packaging is provided with an edge. In this manner a particularly clean and efficient corner joint of the raised article is obtained.

Moreover, according to the invention, the machine may be provided with folding means, preferably in the form of rollers, for folding the cover panel and the edge zone thereof, thereby obtaining a particularly efficient closing of the packaging.

Furthermore, according to the invention, the support plate and/or the retaining plate may be provided with a plurality of through-holes. This results in substantial material savings without compromising the retaining ability of the support plate or the retaining plate.

Further, according to the invention, the corrugated cardboard used may have a weight of at least 80 g/m$^2$. In this way, the finished raised packaging is suitably solid.

Finally, according to the invention, the support plate and/or the retaining plate may be able to execute completely vertical movements in connection with raising a planar article. This permits a particularly simple construction.

BRIEF DESCRIPTION OF THE DRAWING

The invention is explained in detail below with reference to the drawing, in which.

BEST MODE FOR CARRYING OUT THE INVENTION

Figure 1:
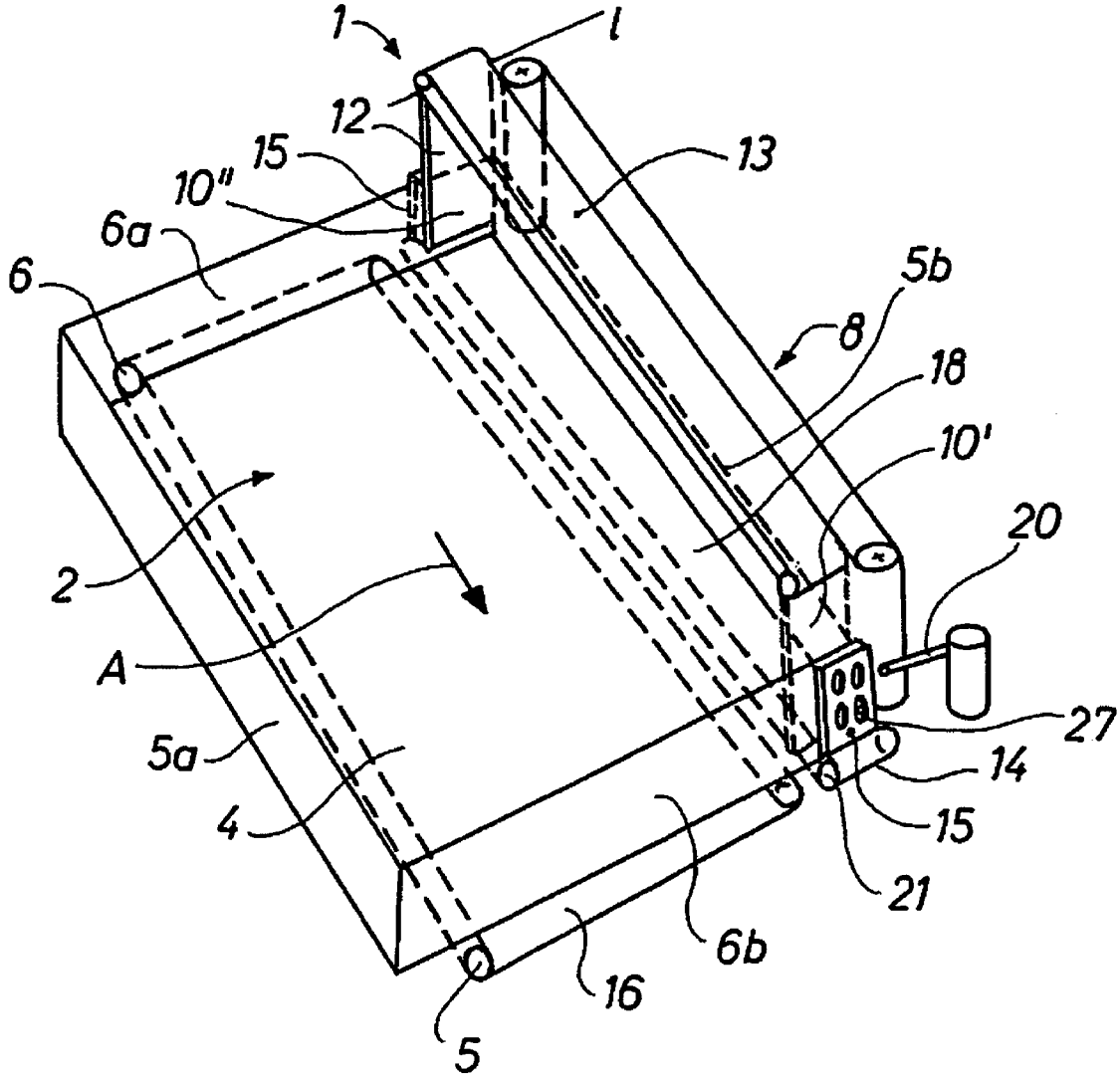
FIG. 1 shows a perspective view of a machine according to the invention.
Figure 2:
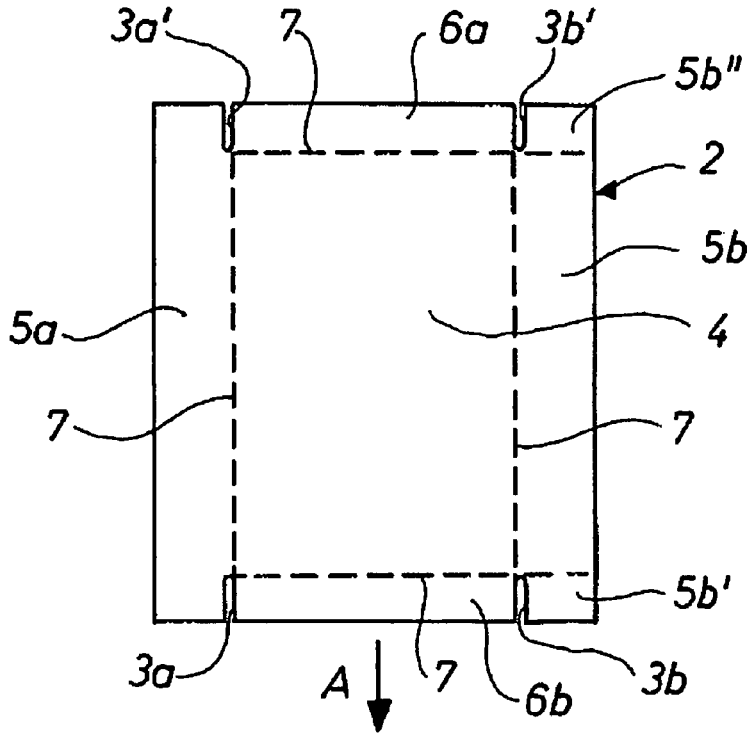
FIG. 2 shows a top view of a planar article to be raised by means of the machine.

The machine depicted in FIG. 1 is provided to raise planar articles 2, preferably made of cardboard, corrugated cardboard or plastics, in order to manufacture box-shaped or crate-shaped packaging. Each article comprises a bottom panel 4, longitudinal side panels 5*a*, 5*b*, transverse end panels 6*a*, 6*b* and optionally a cover panel 25 (FIG. 2).

The machine contains at least one main conveyor 16 by means of which the planar articles 2 are advanced one at a time. Moreover, the machine is provided with side forming means 8 able to exert pressure on the longitudinal side panels of each planar article 2 (FIG. 1 shows side forming means 8 only on the right-hand side of the figure; corresponding side forming means etc. mounted mirror-inverted have to be imagined on the left-hand side of the figure and parallel to the side forming means 8 depicted on the right-hand side).

Moreover, the machine is provided with transversely arranged end forming means 15 movable with respect to the advance direction A of the main conveyor 16 and able to exert pressure on said end panels and turning the latter predominantly 90° with respect to the plane of the bottom panel 4, when the end panels 6*a*, 6*b* of a planar article 2 are positioned opposite said end forming means, while the article is advanced in the direction of arrow A.

Furthermore, the machine is provided with the joining means 12 to be used for joining the side panels 5*a*, 5*b* and the end panels 6*a*, 6*b* of each article.

These joining means may be comprised of an inner pivotable support plate 12 movable by means of a conveyor 13 movable between a front position 10' at a front corner of the packaging 2 and a rear position 10" at a rear corner of the packaging 2; moreover, the end forming means may comprise a low retaining plate 15 mounted on a secondary conveyor belt 18, said retaining plate being movable from a position just in front of the front end panel 6*b* (cf. FIG. 1) of the packaging to a position just behind the rear end panel 6*a* of the packaging by means of said belt. In both positions, a clamping action may be provided between the retaining plate 15 and the support plate 12.

As mentioned above, the joining means may also comprise glue supply means for supplying glue to the area between the retaining plate 15 and the support plate 12 at the corners of the article 2. The glue is preferably of the hot melt type.

As mentioned above, the joining means may also be comprised of stapling means for e.g. stapling each side panel 5*b* to the adjacent end panel 6*b* by means of metal staples.

As for the planar article 2 (cf. FIG. 2), when the longitudinal side panel 5*b* is rotated 90° upwards with respect to the bottom panel 4, whereupon the end panel 6*b* (as well as the end panel 6*a*) are rotated 90° upwards with respect to said bottom panel, an end portion 5*b*' (cf. FIG. 2) is rotated 90° with respect to the longitudinal side panel 5*b* by means of the retaining plate 15 and the support plate 12 so that a regular corner is formed in the packaging. When the support plate 12 has formed the front right-hand corner (at 10'), it is moved back to a rear position at a rear corner of the packaging (at 10"). At both end positions a strong clamping action may be established between the support plate 12 and the retaining plate 15, because the retaining plate 15 is mounted on a separate conveyor, i.e. the secondary conveyor belt 18. As is apparent, the retaining plate 15 always acts upon the packaging being raised from the outside. In contrast, the support plate 12 always acts upon the packaging from an inside position: at first at a forward position 10' and then at a rear position 10". The support plate 12 is moved by means of a belt conveyor 13 and projects downwards for most of the operation, towards the end, however, when the article 2 has to be moved past the support plate 12, said support plate may be pivoted upwards by means (not shown) to an almost horizontal position (around a horizontal line 1, cf. FIG. 1) so that the packaging pressed upwards is able to pass the support plate 12. The practical means for this are not shown in the drawing. When the next article 2 to be folded is transported forward on the main conveyor, the support plate 12 is moved to a position in the vicinity of position 10' by the conveyor 22, where it pivots down in a vertical direction. The support plate is now in a position inside what will subsequently become a folded packaging While the new article 2 is transported forward by the main conveyor 16, the retaining means 15 is moved forward from a position at the rear end of the packaging to a position in front of the front end of the packaging. It should be noted that the retaining plate projects permanently at right angles from the secondary conveyor belt 18. The movement executed by the support plate 12 when returning to its rear position 10" after having been in its front position 10' is a translational movement.

As shown in FIG. 2, each article may be provided with two short parallel slots 3*a*, 3*b*, 3*a*', 3*b*' in its end panels 6*a* and 6*b* for defining a front wall 6*a* and a rear wall 6*b*, respectively, in the packaging. Rectilinear narrow depressions 7 may be formed in the article 2 at those locations of the article where the packaging is provided with folded edges.

Figure 3:
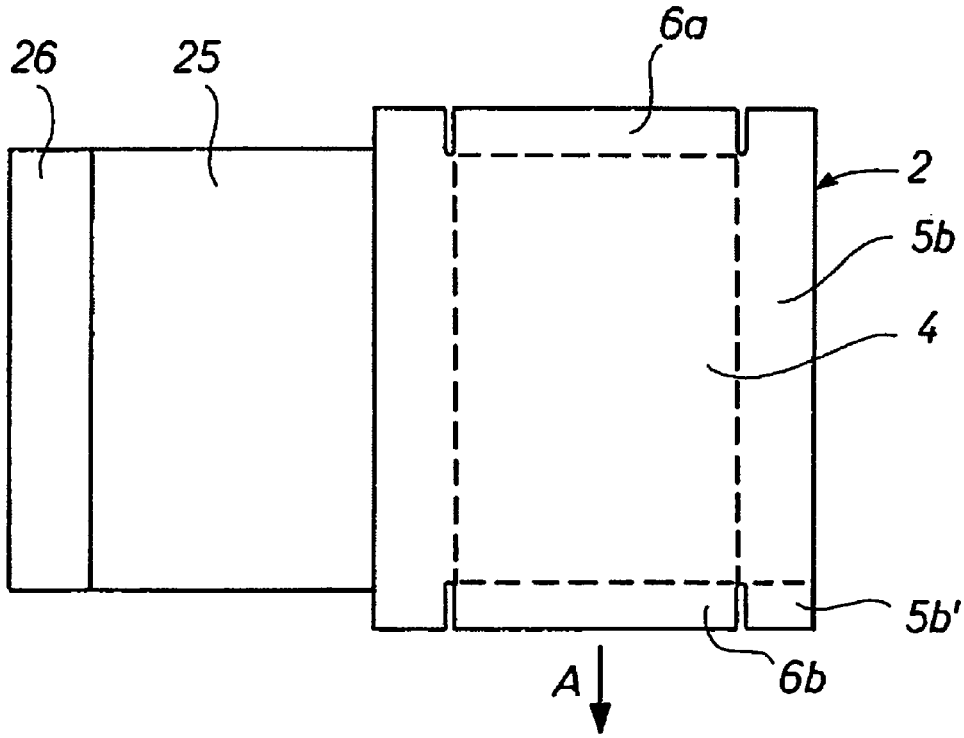
FIG. 3 shows a second flatly laid-out article, but with integrated cover.

As shown in FIG. 3, the article 2 may be provided with a cover panel 25. An edge zone 20 may be provided along one of the edges of the cover, said edge zone being folded approx. 90° with respect to the cover panel so that the edge zone is to form a closing flap, when the cover 25 of the finished packaging is pivoted down to close the remaining part of the packaging. The means for folding the cover 25 and said edge zone 26 are preferably rollers, however, they are not shown in FIG. 1.

Optionally, the support plate 12 and/or the retaining plate 15 may be provided with a plurality of through-holes 27. Thus, the consumption of material for the support plate 12 and/or the retaining plate 15 may be reduced, thereby decreasing the consumption of material for the machine.

Instead of being pivotable, the support plate 12 and/or the retaining plate 15 may execute completely vertical movements (displacements); for example, the support plate 12 and/or the retaining plate 15 may move in several vertical lateral guideways (not shown).

It is also conceivable, that the end portions 5*b*' and 5*b*" of the longitudinal side panel 5*b* and the corresponding end portions of the side panel 5*a* may be cut off, however this is not shown. In this case, the adjacent side panels 5*b* and 6*a*; 5*a* and 6*a*; 6*b* and 5*a*; 6*b* and 5*b* may each form a corner of the packaging, for example by means of glue seals (not shown) fastened around the respective corner from the outside and/or the inside.

Preferably, the corrugated cardboard used for the planar articles 2 may have a weight of at least 80 g/m$^2$. However, it is possible to use other types of corrugated cardboard.

The invention claimed is:

1. A machine for raising planar articles, made of cardboard, corrugated cardboard or plastics, in order to manufacture box-shaped or crate-shaped packagings, and where each article is provided with a bottom panel, longitudinal side panels, transverse end panels and optionally a cover panel the machine comprising:

at least one main conveyor, the planar articles being advanced one at a time by said main conveyor;

a side forming device able to exert pressure on the longitudinal side panels of each article and rotating them predominantly 90° upwards with respect to a plane of the bottom panel;

a transversely arranged end forming device movable in longitudinal direction (A) with respect to the main conveyor and able to exert pressure on said end panels and turning the end panels predominantly 90° with respect to the plane of said bottom panel, when the end panels of a planar article are positioned opposite said end forming device; and a joining device for joining the side panels and the end panels of each article, the joining device comprising an inner pivotable support plate movable between a front position at a front corner of the packaging and a rear position at a rear corner of the packaging, and wherein the transversely arranged end forming device comprises a low retaining plate mounted on a secondary conveyor belt, said low retaining plate being movable from a first position just in front of the front end panel of the packaging to a second position just behind the rear end panel of the packaging by the secondary conveyor belt, where a clamping action between the retaining plate and the support plate is provided in both the first position and the second position.

2. The machine according to claim 1, wherein the joining device further comprises a glue supply device for supplying glue to an area between the retaining plate and the support plate at corners of the article.

3. The machine according to claim 1, wherein the retaining plate is mounted on the lower continuous secondary belt in such a manner that the retaining plate permanently projects from the lower continuous secondary belt at right angles.

4. The machine according to claim 1, wherein the support plate is adapted and mounted in such a manner that it can be moved translationally with respect to the inside of the packaging from a position at a front corner inside the packaging to a rear corner inside the packaging, and is finally rotatable upwards so that the adjacent end panel of the article can pass below and past the support plate.

5. The machine according to claim 1, further comprising a folding device, wherein the article is provided with a cover panel, optionally with a narrow folded edge zone at at least one of the free edges of the cover panel, and wherein the folding device folds the cover panel and the optional edge zone(s) thereof.

6. The machine according to claim 5, wherein the folding device comprises at least one roller.

7. The machine according to claim 1, wherein the support plate and/or the retaining plate are provided with a plurality of through-holes.

8. The machine according to claim 1, wherein the support plate and/or retaining plate are able to execute completely vertical movements in connection with raising a planar article.

* * * * *